United States Patent [19]

Vanden Hoek et al.

[11] Patent Number: 4,723,629

[45] Date of Patent: Feb. 9, 1988

[54] EXTENSION LADDER WITH AUXILIARY EXTENSION LEG AND SUPPORTING LEGS

[75] Inventors: Vernon M. Vanden Hoek, , Lynnville, Iowa 50153; Leonard J. Maasdam, Pella, Iowa

[73] Assignee: Vernon M. Vanden Hoek, Pella, Iowa

[21] Appl. No.: 14,549

[22] Filed: Feb. 13, 1987

[51] Int. Cl.[4] ..... E06C 5/36; E06C 7/46

[52] U.S. Cl. ..... 182/107; 182/172

[58] Field of Search ..... 182/107, 170, 205, 172

[56] References Cited

U.S. PATENT DOCUMENTS

| | | | |
|---|---|---|---|
| 766,385 | 8/1904 | Richardson . | |
| 840,365 | 1/1907 | Pease | 182/107 |
| 1,083,744 | 1/1914 | Jones . | |
| 1,251,761 | 1/1918 | Enke . | |
| 1,710,026 | 4/1929 | McCormick | 182/107 |
| 1,910,551 | 5/1933 | Kruse . | |
| 2,113,282 | 4/1938 | Quinn | 182/205 |
| 2,139,479 | 12/1938 | Wertz . | |
| 3,043,397 | 7/1962 | Tillotson | 182/170 |
| 4,565,262 | 1/1986 | Hawkins . | |
| 4,632,220 | 12/1986 | Murrell | 182/170 |

FOREIGN PATENT DOCUMENTS

| | | | |
|---|---|---|---|
| 2166793 | 5/1986 | United Kingdom | 182/107 |

*Primary Examiner*—Reinaldo P. Machado

*Attorney, Agent, or Firm*—Zarley McKee, Thomte, Voorhees & Sease

[57] ABSTRACT

An extension ladder includes outwardly facing auxiliary rail channels at the lower end on each of the side rails which nestingly engage inwardly facing channels on auxiliary legs extending at an angle to the plane of the ladder for supporting the ladder on irregular terrain in a stable manner. The leg assemblies are selectively positioned independently of each other and locked in a desired position by spring-loaded fingers carried on the leg assembly channels which engage teeth on the ladder rail channels. An extension leg for either of the ladder rails is provided which nestingly engages the ladder rail channel and is locked in place by a spring-loaded finger engaging the teeth on the rail channel.

9 Claims, 10 Drawing Figures

EXTENSION LADDER WITH AUXILIARY EXTENSION LEG AND SUPPORTING LEGS

BACKGROUND OF THE INVENTION

Extension ladders are normally supported in an upright position at their upper ends by the vertical wall of a building or the like and at the bottom end on the ground surface. The ground surface may be irregular such that only one lower end of the two ladder rails engage the ground thus making the ladder unsafe. Even if both rail lower ends engage the ground there may be slippage away from the vertical surface causing the ladder to fall and making it dangerous and unsafe.

There have been auxiliary leg structures for step ladders but these ladders do not rest against a vertical wall surface or the like at the upper end of the ladder. These legs are also positioned high up on the ladder thereby substantially changing the ladder's operation.

SUMMARY OF THE INVENTION

The extension ladder of this invention rests at its upper end against a vertical wall and may be optionally supported at its lower end by the lower ends of the rails of the ladder or by independently movable leg assemblies which include legs extending at an angle to the plane of the ladder and engaging the support surface. The legs of the leg assemblies are rigid in their angularly relationship to the ladder and may be selectively adjusted to provide supporting contact with the ground surface no matter what the terrain is on which the ladder is placed.

Each of the rails of the ladder include outwardly facing auxiliary rail channels which carry teeth which in turn are engaged by inwardly facing channels on leg assemblies which nestingly engage the rail channels. The leg assemblies carry spring-loaded fingers for selectively engaging the teeth on the rail channels.

An extension leg is provided for either of the ladder rails and is mounted on the outwardly facing rail channels and carries a spring-loaded finger for engagement with the rail channel teeth. The extension leg may be rotated 180° and nestingly mounted on the opposite rail channel. Only one extension leg is ordinarily required in order to compensate for the irregular terrain. The extension leg is only needed as an extra precautionary measure since the ladder may be supported entirely by the auxiliary leg assemblies and the vertical wall against which the upper end of the ladder rests. The lower ends of the ladder rails may be out of contact with the support surface although ideally they would engage the ground.

A leg assembly may be easily removed from the rail channels leaving the ladder with only the rail channels at which time the ladder may function as a conventional extension ladder.

DESCRIPTION OF THE PREFERRED EMBODIMENT

Figures 1, 2, 4:
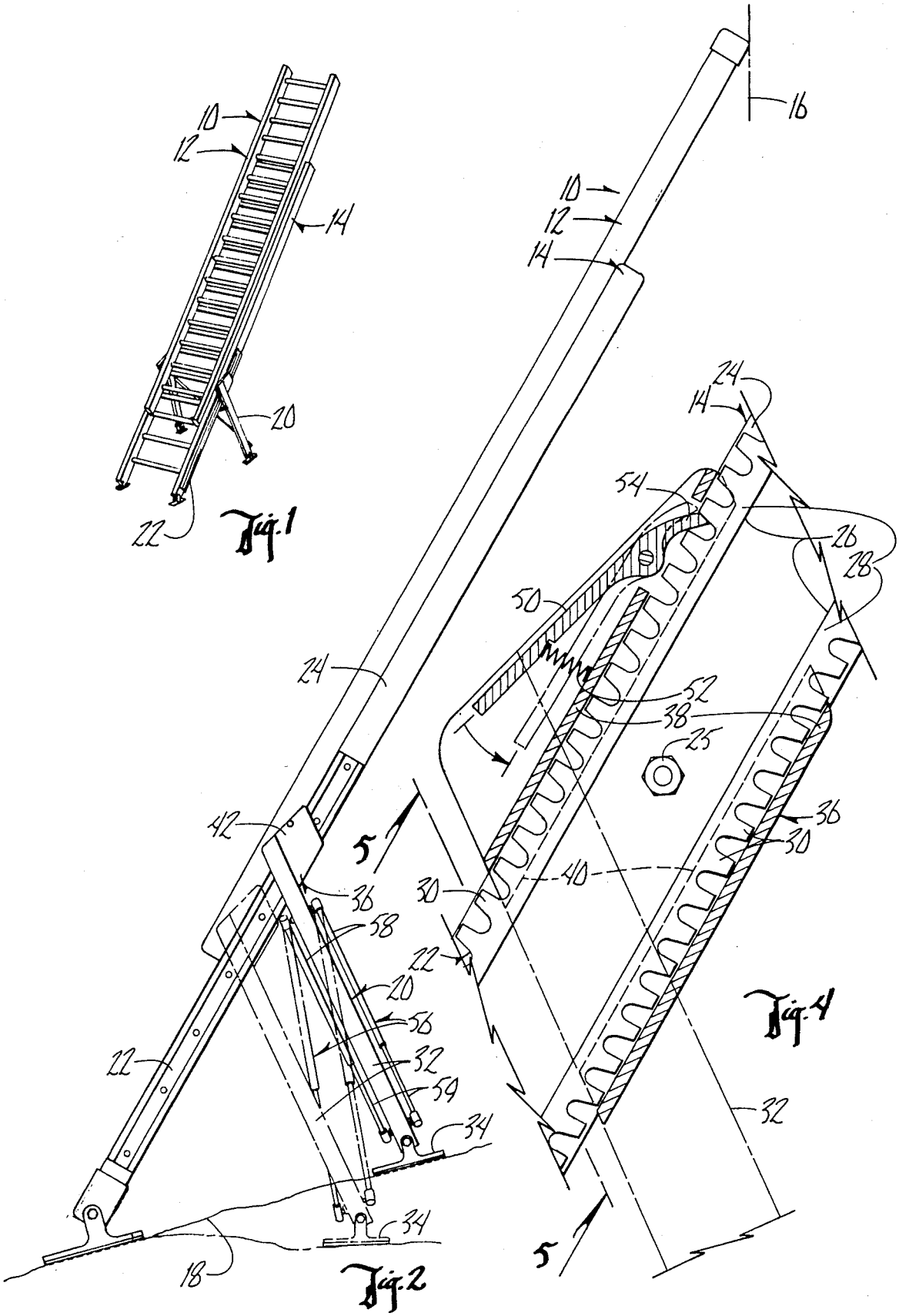
FIG. 1 is a perspective view of the extension ladder of this invention including the auxiliary leg assemblies.
FIG. 2 is an enlarged side-elevational view thereof.
FIG. 4 is a cross-sectional view taken along line 4—4 of FIG. 3.
Figure 3:
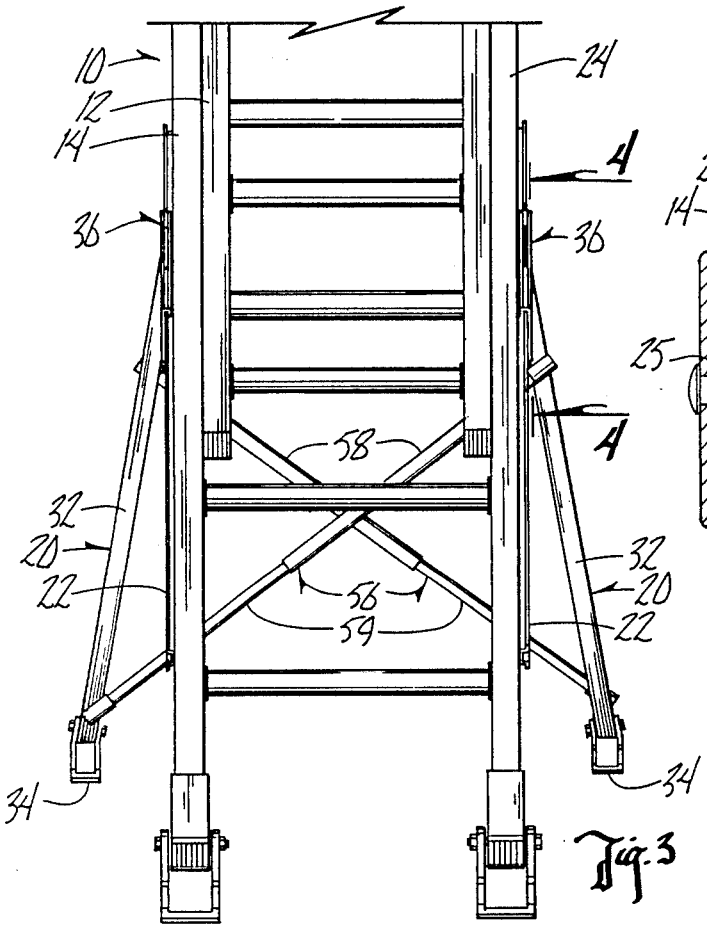
FIG. 3 is a fragmentary front elevational view of the lower end of the ladder showing both of the leg assemblies.

The extension ladder of this invention is referred to generally in FIG. 1 by the reference numeral 10 and includes an upper section 12 telescopically engaging a lower section 14. As seen in FIG. 2, the upper end of the upper section 12 engages a wall support surface 16 while the lower end of the lower section 14 engages a ground surface 18.

Figure 5:
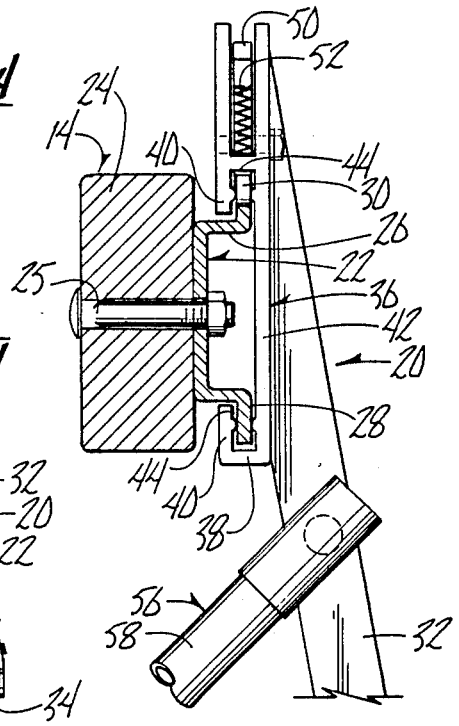
FIG. 5 is a cross-sectional view taken along line 5—5 in FIG. 4.

A leg assembly 20 is provided on each side of the lower end of the lower ladder section 14. An outwardly facing auxiliary channel 22 is secured to each of the lower ladder section rails 24 by bolts 25 as seen in FIG. 5. The rail channel 22 includes outwardly extending legs 26 which terminate in laterally oppositely extending flanges 28 which include teeth 30 along their side edges.

The leg assembly 20 includes a leg member 32 engaging the ground at its lower end 34 and at its upper end includes an inwardly facing channel 36 nestingly engaging the outwardly facing rail channel 22. The leg assembly channel includes inwardly extending legs 38 which terminate in flanges 40 extending towards each other. The base 42 of the leg channel in cooperation with the flanges 40 provide slots 44 in which the flanges 28 are received. A finger 50 is biased by a spring 52 such that the outer end 54 selectively engages the teeth 30 to lock the leg assembly in any desired position along the rail channel 22.

Each of the leg assemblies 20 are interconnected by crisscross extension braces 56 having telescoping extendable sections 58 and 59 which allow for the leg assemblies to be adjusted to different positions depending on the terrain on which the ladder is resting.

As seen in FIGS. 7–10, an extension leg 60 is provided which may be connected to the rail channel 22 on either side of the ladder as needed to further stablize the ladder for maximum safety. The extension leg assembly includes a leg member 62 having a lower foot end 64 and an upper end which includes a inwardly facing channel 66 having legs 68 terminating in flanges 70 extending towards each other to provide a slot 72 to receive the flange 28 on the rail channel 22.

Figure 6:
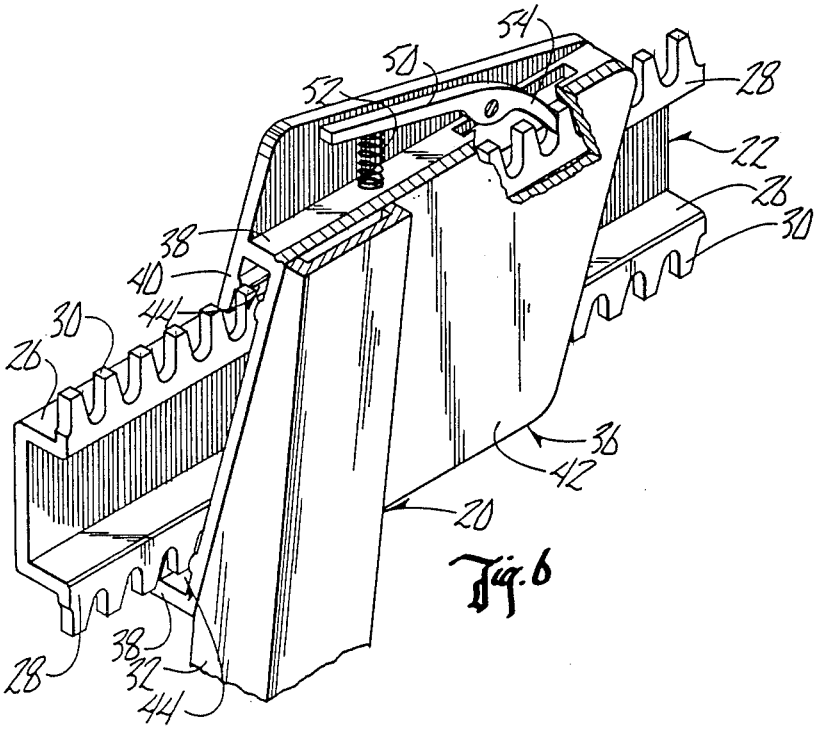
FIG. 6 is an enlarged fragmentary view of the ladder rail channel nestingly engaged in the leg assembly channel.
Figure 7:
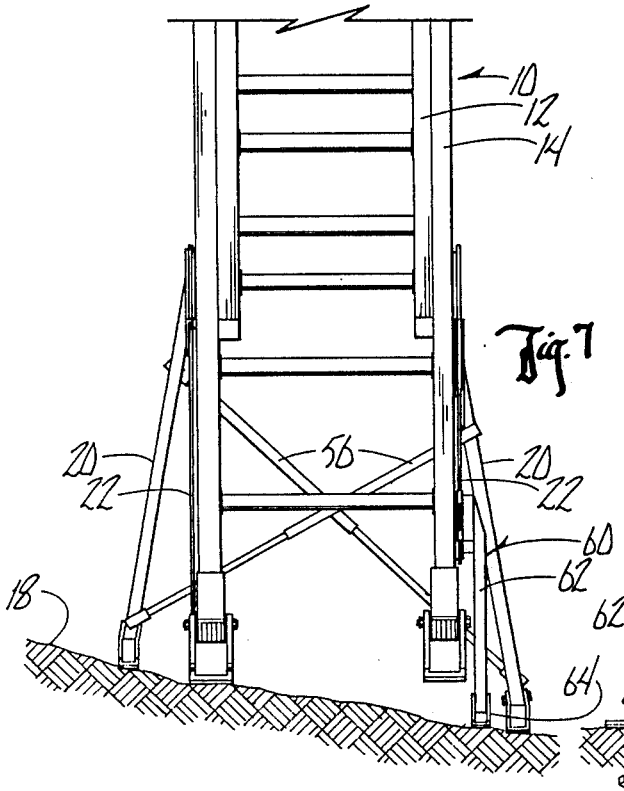
FIG. 7 is a front elevational view similar to FIG. 3 but showing one of the ladder rails including an extension leg mounted on the rail channel member.
Figure 8:
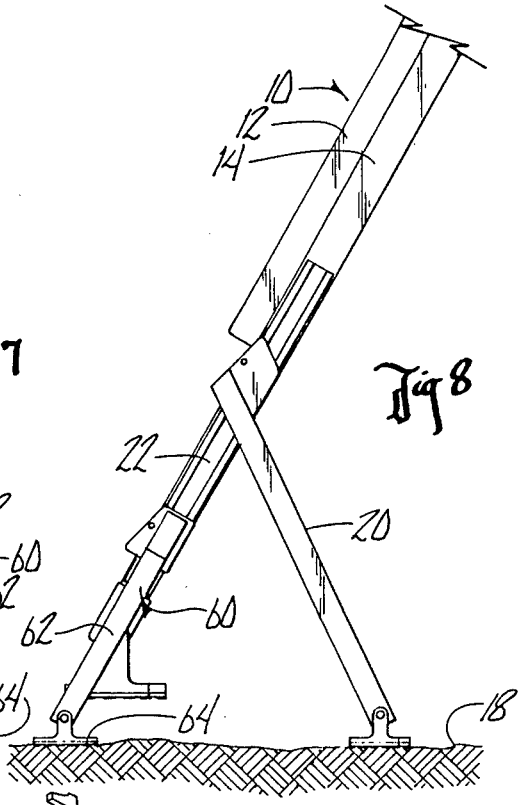
FIG. 8 is a fragmentary side elevational view from the right side of FIG. 7.
Figure 9:
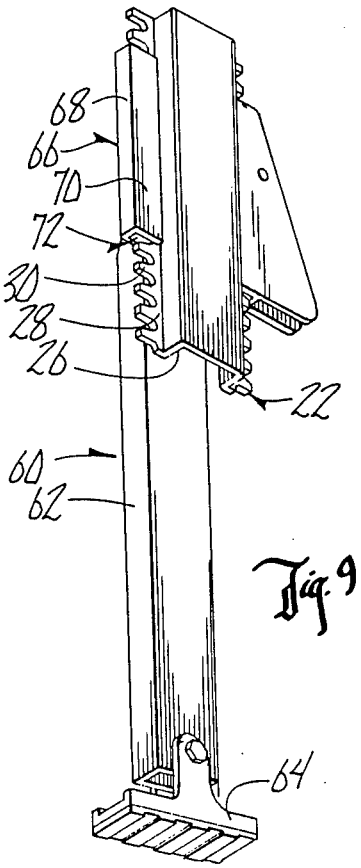
FIG. 9 is a perspective view of the leg extension nestingly engaging the rail channel member on the left side of the ladder as viewed in FIG. 7.
Figure 10:
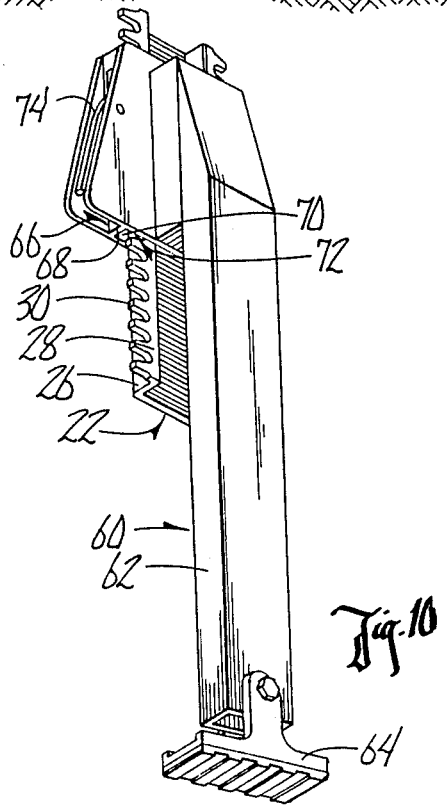
FIG. 10 is a perspective view of the extension leg nestingly engaging the rail channel member on the right side of the ladder as viewed in FIG. 7.

A spring-loaded finger 74 similar to finger 50 in FIG. 6, also engages the teeth 30 to selectively lock the extension leg in a desired position. It is seen in FIG. 9 that the extension leg 60 is mounted on the rail channel 22 for the left-hand side of the ladder while the leg extension in FIG. 10 is mounted on the rail channel 22 for the right-hand side of the ladder. Thus, one leg of the extension may be used on either side of the ladder by simply rotating it 180°. Teeth on both the upper and lower flanges 28 of the rail channels 22 accommodate the extension legs when mounted on either side of the ladder.

Thus in operation it is seen that complete flexibility is possible through the use of the auxiliary legs assemblies 20 and the extension legs 60. One or both, or none, of the leg assemblies 20 may be used and the extension leg 60 may or may not be used and if used, may be used to extend either of the ladder side rails. The auxiliary leg 20 extends at an angle to the plane of the ladders and is located close enough to the lower end such that the leg assemblies take the substantial load of the ladder rather than the lower ends along with the upper end of the ladder resting against the side of a building or the like. The ladder cannot slip away from the building when supported by the auxiliary leg assemblies. It is to be appreciated that the leg assemblies 20 do not make the extension ladder into a step ladder since the support leg of a step ladder extends from the top end of the ladder section rather than closely adjacent the lower end as is the case with the auxiliary leg assemblies of this invention. Use of the extension leg, as indicated, is optional and simply provides additional stability if desired.

What is claimed is:

1. An extension ladder having upper and lower ends and opposite side rails comprising, an auxiliary supporting leg assembly independently movably connected to each side rail to be selectively positioned longitudinally of said ladder adjacent the lower end of said ladder, said leg assembly including a leg member extending at an angle to the plane of said ladder and engaging at its outer end a support surface, said ladder having sufficient length and said leg assemblies being positioned sufficiently close to the lower end of said ladder that said ladder is supported and stablized against movement by the upper end of the ladder bearing against an upstanding structure and the leg members engaging said support surface, said leg assembly including an elongated channel member secured to said rail and said channel member including outwardly extending legs with each of said legs having outer edge portions extending in a plane perpendicular to the plane of the ladder and one of said edges including a series of teeth engaged by the upper end of said leg member.

2. The structure of claim 1 wherein said ladder includes upper and lower sections telescopically interconnected.

3. The structure of claim 1 wherein said legs of said leg assemblies include extendable interconnecting brace members to allow for said leg assemblies to be positioned at different points along said ladder.

4. A ladder having upper and lower ends and opposite side rails having inner and outer sides comprising, an auxiliary supporting leg assembly independently movably connected to each side rail to be selectively positioned longitudinally of said ladder adjacent the lower end of said ladder, said leg assembly including a leg member extending at an angle to the plane of said ladder and engaging at its outer end a support surface, said ladder having sufficient length and said leg assemblies being positioned sufficiently close to the lower end of said ladder that said ladder is supported and stabilized against movement by the upper end of the ladder bearing against an upstanding structure and the leg members engaging said support surface, and each of said ladder rails having auxiliary rails secured to said outer sides thereof and said leg assemblies and said auxiliary rails including cooperating lock means for selectively positioning said leg assemblies at a desired position along the length of said auxiliary rails.

5. An extension ladder having upper and lower ends and opposite side rails comprising, an auxiliary supporting leg assembly independently movably connected to each side rail to be selectively positioned longitudinally of said ladder adjacent the lower end of said ladder, said leg assembly including a leg member extending at an angle to the plane of said ladder and engaging at its outer end a support surface, said ladder having sufficient length and said leg assemblies being positioned sufficiently close to the lower end of said ladder that said ladder is supported and stablized against movement by the upper end of the ladder bearing against an upstanding structure and the leg members engaging said support surface, an elongated outwardly facing channel member secured to each of said rails, the outer edges of the legs of said channel member including laterally outwardly oppositely extending flanges, one of said flanges including a series of teeth, and the upper end of said leg member including a mating channel member nestingly engaging said rail channel member, and a spring-loaded finger element releasably engaging said teeth to lock said leg member in the desired location along the length of said rail channel member.

6. An extension ladder having upper and lower ends and opposite side rails comprising, an auxiliary supporting leg assembly independently movably connected to each side rail to be selectively positioned longitudinally of said ladder adjacent the lower end of said ladder, said leg assembly including a leg member extending at an angle to the plane of said ladder and engaging at its outer end a support surface, said ladder having sufficient length and said leg assemblies being positioned sufficiently close to the lower end of said ladder that said ladder is supported and stablized against movement by the upper end of the ladder bearing against an upstanding structure and the leg members engaging said support surface, each of said rails including an outwardly facing elongated channel member, each channel member including legs having oppositely extending flanges in planes perpendicular to the plane of the ladder and one of said flanges including a series of teeth, each of said leg assemblies including an inwardly facing channel member having legs including flanges extending towards each other in planes perpendicular to the plane of the ladder and nestingly embracing said flanges on said channel members on said rails, and a finger member carried on said leg assembly for selectively engaging said teeth to lock said leg assembly to said ladder.

7. The structure of claim 6 wherein said legs of said leg assemblies extend laterally outwardly from said rails of said ladder.

8. The structure of claim 6 wherein one of said rails at its lower end includes an extension leg, said extension leg includes an inwardly facing channel member having legs with flanges extending towards each other and in planes perpendicular to the plane of said ladder, and said extension leg channel includes a finger for selectively engaging the teeth on said rail channel member.

9. The structure of claim 8 wherein said extension leg may be turned 180° about its longitudinal axis to nestingly engage the said channel member on the opposite side of said ladder, and said rail channel member includes a series of teeth on both of said flanges.

* * * * *